US008307614B1

(12) United States Patent
Louie

(10) Patent No.: US 8,307,614 B1
(45) Date of Patent: Nov. 13, 2012

(54) SUPPORT ASSEMBLY AND METHOD

(76) Inventor: Stephen Louie, Stokesdale, NC (US)

( * ) Notice: Subject to any disclaimer, the term of this patent is extended or adjusted under 35 U.S.C. 154(b) by 469 days.

(21) Appl. No.: 12/582,176

(22) Filed: Oct. 20, 2009

(51) Int. Cl.
*B65B 35/30* (2006.01)

(52) U.S. Cl. ..... 53/443; 53/495; 53/542

(58) Field of Classification Search ..... 53/443, 53/446, 447, 495, 147, 152, 531, 542
See application file for complete search history.

(56) References Cited

U.S. PATENT DOCUMENTS

| | | | | |
|---|---|---|---|---|
| 769,025 | A | 8/1904 | Sagendorph | |
| 3,325,165 | A | 6/1967 | Davis, Jr. | 271/71 |
| 3,562,775 | A * | 2/1971 | Mullins | 3/448 |
| 3,717,751 | A | 2/1973 | Fluck | 235/92 |
| 3,762,129 | A * | 10/1973 | Salomon | 53/564 |
| 3,840,148 | A | 10/1974 | Fontana | 221/153 |
| 3,915,316 | A | 10/1975 | Pomara, Jr. | 214/6 |
| 4,058,226 | A * | 11/1977 | Peters, Jr. | 414/798.2 |
| 4,162,870 | A * | 7/1979 | Storm | 414/798.5 |
| 4,577,853 | A | 3/1986 | Duke | 271/217 |
| 4,867,436 | A * | 9/1989 | Hanada et al. | 271/221 |
| 4,928,942 | A * | 5/1990 | Aiuola et al. | 271/3.01 |
| 4,949,532 | A * | 8/1990 | Fujimagari et al. | 53/542 |
| 5,016,420 | A * | 5/1991 | Chiappe et al. | 53/138.1 |
| 5,733,099 | A * | 3/1998 | Honneger | 414/788 |
| 5,765,337 | A * | 6/1998 | Lodewegen et al. | 53/493 |
| 5,996,314 | A * | 12/1999 | Pennini et al. | 53/399 |
| 6,354,587 | B1 | 3/2002 | Engarto | 271/149 |
| 6,983,580 | B1 * | 1/2006 | Layton et al. | 53/530 |
| 2003/0009991 | A1 * | 1/2003 | Iwamoto | 53/460 |

* cited by examiner

*Primary Examiner* — Paul R Durand
(74) *Attorney, Agent, or Firm* — Walter L. Beavers; Blake P. Hurt

(57) ABSTRACT

A support assembly for use in packaging and other purposes which includes a pivotable support member engaged by a pawl. The support assembly may move along a rail and collect articles thereagainst which are moving at a rate greater than the support assembly. Once the support member accumulates a predetermined number of articles, a pawl rotates and the support member pivots to allow the accumulated group of articles to pass thereby and be removed from the rail for packaging or other purposes.

14 Claims, 1 Drawing Sheet

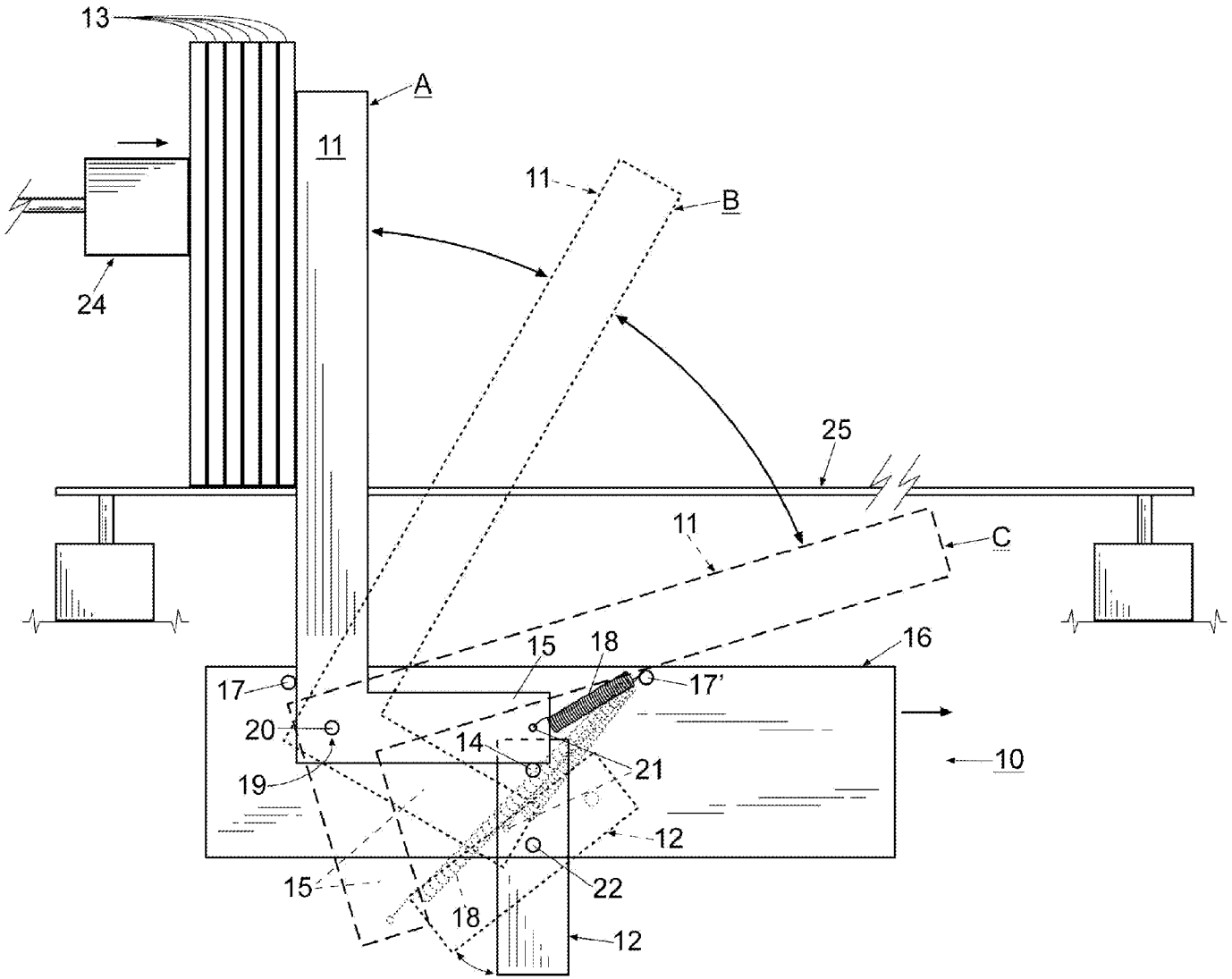
A
B
C
10
11
11
11
12
12
13
14
15
15
16
17
17'
18
18
19
20
21
22
24
25

SUPPORT ASSEMBLY AND METHOD

FIELD OF THE INVENTION

The invention herein pertains to article handling and packaging and particularly pertains to a moveable support assembly utilized with articles transported one at a time in an upright position along rails which are accumulated by the support assembly in predetermined groups for packaging, counting or other purposes.

DESCRIPTION OF THE PRIOR ART AND OBJECTIVES OF THE INVENTION

Different types of packaging, conveying and handling equipment have long been used in the industry to facilitate boxing and wrapping of goods in predetermined numbers to increase the convenience and decrease in damage to the articles during transportation. Of all the goods handled, a major problem exists when relatively thin standing articles are moved along a conveyor or rail system due to the effects of motion and gravity causing the articles to tip or fall from an upright position. Brush tracks, FIHP guides, speed adjustments and the like have all been tried in the past to alleviate such problems with varying degrees of success. However problems are still encountered daily during the movement of standing articles along rails which cause delays, inaccuracies and inconvenience during the packaging process. For example, if six (6) thin boxes are placed upright on a rail for delivery to a packaging area, if one or more of the boxes leans, tilts or falls from the rail, undue time and effort has to be expended to upright, replace or recount the articles before placement in a container for shipment.

Thus, with the problems and disadvantages of current moving/conveying and packing equipment for handling such articles in an upright fashion, the present invention was conceived and one of its objectives is to provide a support assembly which can be used in conjunction with a rail to insure that the selected number of articles can be accumulated and handled efficiently and accurately.

It is another objective of the present invention to provide a support assembly which includes a movable body having a pawl and support member affixed thereto.

It is still another objective of the present invention to provide a method for accumulating and packaging articles utilizing a push rod, rail and movable support assembly.

Various other objectives and advantages of the present invention will become apparent to those skilled in the art as a more detailed description is set forth below.

SUMMARY OF THE INVENTION

The aforesaid and other objectives are realized by providing a movable support assembly for use with a rail system. The movable support assembly includes a movable body having a pivotable support member and rotatable pawl affixed thereto. The support member is L-shaped and can be pivoted from an upright or accumulation position to a prone or release position. The pawl engages and maintains the support member in a vertical, upright position and releases the support member for allowing pivotal movement of the support member to a prone or release position. When in use, standing articles moving on a rail are met and maintained upright by the L-shaped support member whereby a preset number of articles are allowed to accumulate. At a selected time or location the support member pivots to a somewhat prone position whereby the accumulated articles can travel over and beyond the support member for packaging or other purposes. A spring assists in returning the support member to an upright position for accumulating the next set of articles as the cycle is repeated as necessary. Details of the standard mechanisms including electrical circuitry, mechanical, pneumatic or hydraulic actuators, levers, auxiliary handling equipment, supply sources and the like are not included for simplicity purposes.

BRIEF DESCRIPTION OF THE DRAWING

FIG. 1 illustrates in schematic fashion a support assembly as used in conjunction with a rail system for article accumulation during a packaging process.

DETAILED DESCRIPTION OF THE PREFERRED EMBODIMENTS AND OPERATION OF THE INVENTION

For a better understanding of the invention and its operation, turning now to the drawing, FIG. 1 illustrates in schematic representation preferred support assembly 10 with L-shaped support member 11 in multiple positions, generally at A, B and C, in use with rail 25. Support member 11 is shown in imaginary fashion in positions B and C to illustrate the pivotal movement from an upright or vertical position A to a somewhat prone or horizontal position C.

Support assembly 10 includes L-shaped support member 11 and pawl 12, each mounted on body 16 by respectively axles 20, 22. L-shaped support member 11 includes opening 19, foot 15 and spring port 21. Opening 19 is received on axle 20 which is affixed to body 16 to allow pivotable movement of support member 11. Body 16 also includes pins 17, 17' mounted thereto in opposing fashion for limiting the pivotable movement of support member 11 mounted therebetween. Pawl 12 is affixed to body 16 by axle 22 to allow rotation of pawl 12 and includes post 14 thereon. Pawl 12 is seen in FIG. 1 in contact with support member 11 at position A in a vertical posture with foot 15 resting on post 14. Post 14 may be for example a steel rod or bar of sufficient length to maintain foot 15 of support member 11 in a horizontal position at A. Other pawl designs may be used which are slidable (not shown).

Support member 11 at position A retains six (6) articles 13 which may be for example books, magazines or boxes which may have any of a variety of sizes and shapes as shown in FIG. 1 for illustrative purposes. Articles 13 are urged along rail 25 by push rod 24 one at a time in an upright position and meet with support member 11 for accumulation of a preset number for packaging purposes.

Body 16 of support assembly 10 is moveable and travels along rail 25 as schematically illustrated in FIG. 1. Rail 25 may be singular or include two (2) parallel rails 25 (not shown) with support assembly 10 therebetween. Body 16 includes pins 17, 17' which extend therefrom and terminate pivotable movement of support member 11 in upright and prone positions respectively as demonstrated by positions A, B and C. Spring 18 is affixed to pin 17' on body 16 and to spring port 21 in foot 15 of support member 11 to assist in return of support member 11 from the somewhat prone position C to upright position A. Spring 18 seen at position A is in a relaxed state while articles 13 accumulate against support member 11. Once the desired amount of articles 13 are accumulated, support member 11 pivots downwardly towards positions B and C. Spring 18 expands as the accumulated stack of articles 13 moves along rail 25 past support member 11 whereby spring 18 later contracts urging support member 11 to return to upright position A. Pawl 12 returns to its upright position by resilient or other means (not seen) to again maintain support member 11 in an upright posture as seen in position A.

As would be understood, levers, actuators, switches, controllers and other standard electrical or mechanical components are not shown for clarity purposes and could be used for returning support member 11 from for example position C to position A. As articles 13 move along rail 25 at a desired velocity at the urging of push rod 24, support assembly 10 may move therewith at a different velocity to allow accumulation and later release of articles 13 for packaging purposes.

Support assembly 10 can be positioned upright as shown in FIG. 1 at a preset location along rail 25. Articles 13 which may be traveling at a rate greater than support assembly 10 contact support member 11 and accumulate therebehind as illustrated in FIG. 1. Once a predetermined point along rail 25 has been reached by support assembly 10, support member 11 pivots from an upright position A to a somewhat prone position C as pawl 12 rotates by action of a piston rod (not shown) or other usual mechanism, thereby allowing articles 13 to move further along rail 25 as a predetermined group for additional handling, after which support member 11 returns to upright position A. Such handling may include grasping for delivery to another rail or conveyor (not shown), placing them in a container such as a shipping box, wrapping with a wrap or band or other packaging features. Thus, a desired number of articles are collected simultaneously after accumulating together against support member 11.

The method of using support assembly 10 comprises locating support assembly 10 proximate a rail, conveyor or similar machinery. Articles such as upright articles 13 seen in FIG. 1 which are placed on rail 25 are then urged therealong such as by push rod 24. Support assembly 10 is allowed to slow or stop as push rod 24 urges a first article 13 to contact support member 11 and accumulates other articles 13 therewith to form a group. A predetermined number of articles 13 are collected or accumulated by support member 11 of support assembly 10. At a selected time and or location along rail 25, support member 11 pivots from upright position A to prone position C as shown as pawl 12 rotates allowing the group of articles 13 accumulated to pass over support member 11 for packaging or further handling. At that time support assembly 10 returns to its upright position (position A) and pawl 12 with post 14 again maintains support member 11 in upright position A until release. The cycle is repeated as required to accumulate successive groups of articles 13.

The illustrations and examples provided herein are for explanatory purposes and are not intended to limit the scope of the appended claims.

I claim:

1. A method of packaging articles comprising the steps of:
a) placing articles on a rail;
b) moving the articles along the rail;
c) providing a support assembly having a pivotable support member and a pawl mounted on an axle affixed to a body proximate the rail;
d) supporting the articles on the rail with the support member for accumulation;
e) releasing the accumulated articles from the support member by pivoting; and
f) packaging the released articles.

2. The method of claim 1 wherein placing articles on a rail comprises the step of placing articles in a standing position on the rail.

3. The method of claim 1 wherein providing a support assembly comprises the step of providing a movable support assembly having a body with the pivotable support member and pawl joined thereto for selective engagement.

4. A support assembly for use in packaging articles comprising: a pivotable support member, a pawl, said pawl defining an opening, a pawl axle, said pawl axle positioned in said pawl opening, said pawl engaging said support member to prevent said support member from pivoting and disengaging said support member to allow said support member to pivot.

5. The support assembly of claim 4 further comprising a post, said post attached to said pawl, said support member contacting said post.

6. The support assembly of claim 4 wherein said support member defines an opening, a support member axle, said support member axle positioned in said support member opening.

7. The support assembly of claim 4 further comprising a rail, said support assembly positioned proximate said rail.

8. A support assembly for use in accumulating standing articles moving one at a time along a rail for packaging, the support assembly comprising: a body, a pivotable support member, said support member mounted on said body, a pawl, said pawl mounted on said body proximate said support member, a post, said post mounted normal to said pawl, said post for engaging said support member, said support member pivotable to an upright position to accumulate standing articles in a group thereagainst while engaged with said pawl and pivotable to a prone position as said pawl rotates from said support member to allow the grouped standing articles to move along the rail when said support member is disengaged from said pawl.

9. The support assembly of claim 8 wherein said support member is L-shaped.

10. The support assembly of claim 8 wherein said support assembly is proximate said rail, and said support assembly is movable along said rail.

11. A support assembly for use in packaging articles moving in a longitudinal direction comprising: a pivotable support member, said support member pivotable in said longitudinal direction, a pawl, said pawl defining an opening, a pawl axle, said pawl axle positioned in said pawl opening, said pawl engaging said support member to prevent said support member from pivoting and disengaging said support member to allow said support member to pivot in said longitudinal direction to allow said articles to move thereover.

12. The support assembly of claim 11 further comprising a post, said post attached to said pawl, said support member contacting said post.

13. The support assembly of claim 11 wherein said support member defines an opening, a support member axle, said support member axle positioned in said support member opening.

14. The support assembly of claim 11 further comprising a rail, said support assembly positioned proximate said rail.

* * * * *